United States Patent [19]

Mäkinen

[11] 4,358,026

[45] Nov. 9, 1982

[54] APPARATUS AND PROCESS FOR DISPENSING LIQUID PREPARATIONS

[75] Inventor: Esa K. Mäkinen, Espoo, Finland

[73] Assignee: ITP Associates AG, Zug, Switzerland

[21] Appl. No.: 190,441

[22] Filed: Sep. 24, 1980

Related U.S. Application Data

[63] Continuation of Ser. No. 903,910, May 8, 1978, abandoned.

[30] Foreign Application Priority Data

May 10, 1977 [FI] Finland ..... 770125

[51] Int. Cl.[3] ..... B67D 5/06

[52] U.S. Cl. ..... 222/1; 141/18; 222/165; 222/386.5

[58] Field of Search ..... 222/136, 148, 167, 169, 222/386.5, 1, 165; 401/145; 137/240; 220/5 A; 248/129, 137, 141, 142; 141/2, 18

[56] References Cited

U.S. PATENT DOCUMENTS

| | | | |
|---|---|---|---|
| 1,709,091 | 4/1929 | Nissly | 222/136 X |
| 1,832,523 | 11/1931 | Berger | 248/129 |
| 1,839,729 | 1/1932 | Barels | 248/137 |
| 1,942,741 | 1/1934 | Austin | 248/129 X |
| 2,571,476 | 10/1951 | Offutt | 222/386.5 X |
| 2,746,648 | 5/1956 | Grossman et al. | 222/136 |
| 2,819,679 | 1/1958 | Wilson | 222/386.5 X |
| 2,924,359 | 2/1960 | Beremand | 222/386.5 |
| 3,063,411 | 11/1962 | Phillips et al. | 222/386.5 X |
| 3,178,157 | 4/1965 | Cole | 222/136 X |
| 3,674,205 | 7/1972 | Kock | 137/240 X |
| 3,713,412 | 1/1973 | Ianuzzi | 220/5 A X |
| 4,067,485 | 1/1978 | Soin | 222/386.5 |

*Primary Examiner*—F. J. Bartuska

*Attorney, Agent, or Firm*—Gordon W. Hueschen

[57] ABSTRACT

Apparatus for dispensing liquid preparations which comprises a container having demountable upper and lower container parts, the upper container part of which has a pressurized-fluid inlet connected by a flexible connecting line to a source of pressurized fluid and a vent, a flexible diaphragm located in the container so as to provide an expandable and contractable pressurized-fluid chamber and an expandable and contractable preparation chamber in the container, a charging and discharging orifice in the lower container part, and a flexible connecting line connecting that orifice with a point at which fluid is discharged. The container is mounted for rotation on a horizontal axis for allowing rotation of the container from a position in which the charging and discharging orifice in the lower container part is uppermost for filling and lowermost for discharge. The vent is so located with reference to the charging orifice that a back pressure is maintained in the pressurized-fluid container part sufficient to prevent collapse of the diaphragm faster than liquid preparation is fed in through the charging orifice.

4 Claims, 5 Drawing Figures

APPARATUS AND PROCESS FOR DISPENSING LIQUID PREPARATIONS

BACKGROUND OF THE INVENTION

1. Field of the Invention

The present invention relates to an apparatus and process for dispensing liquid and is particularly directed to apparatus and process for applying paints, coating agents, impregnating agents, insulating agents, adhesives, lacquers, plastics and like liquid spreadable preparations.

It is the object of the present invention to provide an apparatus and process for the purpose of carrying out the dispensing of liquid preparations in a substantially more efficient manner as compared with the methods hitherto customary for this purpose. This means that the application of spreadable preparations can take place more economically and more uniformly and without processing losses, at a predetermined layer thickness of the coating. Moreover, for reasons of occupational health and environmental pollution it is intended to restrict the evolution of noxious vapours when using preparations which contain organic solvents. Furthermore, the new apparatus should also be suitable for coating large areas both outside and inside, for example in shipping, on tanks and in the rust-prevention sector. In addition, no wearing parts should be present in the apparatus as far as possible. The apparatus should be very reliable in operation, not require any motor, not cause any noise and be simple to operate and to maintain. According to the invention, the apparatus should, however, also be suitable for conveying liquids of any type, for example the conveying of beer from the storage cellar into the taproom of liquid media on building sites and of fuel oil from a storage room at a lower position to the oil furnace located at a higher level.

Thus, the surface treatment of pipes in industrial plants or other surfaces which are complicated with respect to painting technology, is in general carried out by spreading the paint using a brush. An application method of this type, in which the painter must first dip the brush into the paint container and then spread the paint onto the surface, is not only extremely time-consuming, but it can lead to direct or long-term bodily injuries—caused by a frequently very awkward working position. Additionally, pipes and similar complicated objects to be painted are frequently laid at a fairly high level or in localities within difficult access, so that the working procedure is made more difficult by often dangerous climbing and laborious transports of the paint containers.

An application method which is fairly frequently used and is efficient, consists in spraying the paint, but this method is rather unsuitable for painting complicated surfaces. An essential disadvantage is that the paint must frequently be transported over considerable distances and large level differences so that the paint pumps must have a disproportionate size.

A particular advantage of the apparatus and process of the present invention is that it is possible to apply not only preparations consisting of a single component, but also two-component and multi-component preparations, without having to produce a premix. Finally, it is also possible to produce and to apply controllable mixtures of preparations in different colour shades.

SUMMARY

The invention relates to an apparatus and process for dispensing liquids and particularly to apparatus and process for applying paints, coating agents, impregnating agents, insulating agents, adhesives, lacquers, plastics and like liquid spreadable preparations to a surface comprising the feeding of liquid to be dispensed into one compartment of a container divided into two compartments by a flexible diaphragm in which the other compartment is filled with a fluid under sufficient pressure to have displaced the diaphragm into the one compartment; the maintaining of a balance in the pressure in the two compartments such that the diaphragm is displaced into the other compartment only so fast as liquid to be dispensed is fed into it until it is adequately filled with liquid to be dispensed; and thereafter, the increasing of the pressure in the other compartment sufficiently to force liquid to be dispensed from the one compartment. More particularly, the apparatus for dispensing liquid preparations of the invention comprises a spherical container having demountable upper and lower hemispherical container parts, separated by a soft, flexible diaphragm adapted to provide a gas-tight, expandable and contractable pressurized-fluid chamber and an expandable and contractable preparation chamber, in which the upper container part has at its acme a pressurized-fluid inlet means connected by a flexible line to a source of pressurized fluid and to vent means, whereby pressurized fluid can be charged into the pressurized-fluid chamber or vented therefrom as need be, in which the lower container part has at its nadir an orifice comprising separate filling means and discharge means through which a fluid may be charged into or discharged from the preparation chamber, in which the discharge means is connected by a flexible connecting line connecting it with a point at which the fluid is discharged; means for mounting the container for rotation about a horizontal axis for allowing rotation from a position in which the orifice in the lower container part is uppermost for filling preparation into the preparation chamber to a position in which the orifice is in position for discharge of fluid therefrom, in which the flexible connecting lines are long enough to permit the rotation of the container for the stated purpose; and back-pressure-establishing means for establishing a back-pressure in the pressurized-fluid chamber such that the diaphragm does not collapse during filling faster than the preparation is fed into the preparation chamber.

Advantageously, the back-pressure establishing means comprises the vent means being located at a higher level relative to the filling orifice when the container is in filling position, such that the diaphragm is displaced into the pressurized-fluid chamber only so fast as liquid preparation is introduced into the preparation chamber.

An embodiment of the apparatus is characterised in that the outer rim of the diaphragm is located between the rims of the upper container part and the lower container part.

An embodiment of the apparatus is characterised in that the outer rim of the diaphragm between the rims of the upper container part and the lower container part is held in compression, making a seal, by holder elements fitted to the outside of the upper container part and the lower container part.

Another embodiment of the apparatus is characterised in that the outer rim of the diaphragm is designed as a groove and tongue and the rims of the upper container part and the lower container part are designed to engage in the groove and tongue.

An embodiment of the apparatus is characterised in that the outer rim of the diaphragm contains, as a gasket, a reinforcement having a circular cross-section, and the rims of the upper container part and the lower container part contain an annular recess which has a semicircular cross-section and which is to receive the gasket on the rim of the diaphragm.

A further preferred embodiment of the apparatus is characterised in that the container, designed as a spherical container, consists of two hemispherical container shells.

A further embodiment of the apparatus is characterised in that the diaphragm is designed as a hemispherical shell having a gasket ring as the rim.

A special embodiment of the apparatus is characterised in that the apparatus comprises (a) at least two containers which are each provided with a diaphragm, subject to the action of a pressure medium, and are to receive different colours or components, the two containers being arranged upstream of a mixing vessel, and (b) a connecting line for transporting the paint or the liquid preparation from the mixing vessel to the application device.

A special embodiment of the apparatus is characterised in that four containers which are each provided with a diaphragm and are to receive red, yellow, green and blue paint or different components, and a fifth container which are provided with the diaphragm and is to receive the diluent, and four connecting lines and a further connecting line for, respectively, conveying the said paints or components and the diluent onwards to the mixing vessel are provided.

A further special embodiment of the apparatus is characterised in that, respectively, two connecting lines or five connecting lines are provided for conveying the pressure medium to two diaphragms or five diaphragms.

A special version of the preceding embodiment is characterised in that, respectively, two connecting lines or five connecting lines are provided with two valves or five valves.

A further embodiment of the apparatus is characterised in that, respectively, two connecting lines or five connecting lines are linked to the same pressure vessel.

A further embodiment of the apparatus is characterised in that, respectively, the two connecting lines or five connecting lines leading to the mixing vessel are provided with two valves or five valves.

A further embodiment of the apparatus is characterised in that, respectively, the two connecting lines or five connecting lines leading to the mixing vessel are provided with two controllable nozzles or five controllable nozzles.

A further embodiment of the apparatus is characterised in that a mixing vessel is equipped with a mixer device.

A further embodiment of the apparatus is characterised in that the equipment is held in a frame which is transportable on at leat two wheels.

A further preferred embodiment of the apparatus is characterised in that the equipment held in a frame carries a valve arrangement for the pressure medium which is to be introduced, in order to deliver the liquid preparation, intended to be applied, to the application device or to cause the pressure medium to flow out of the container when the liquid preparation intended to be applied is filled in.

A further preferred embodiment of the apparatus is characterised in that the diameter of the orifice in the lower container part is greater than that of the orifice in the upper container part in order to enable even viscous liquid preparations to be filled in rapidly and without bubbles.

A further embodiment of the apparatus is characterised in that the inner surface of the lower container part, which surface consists of a material which is inert to the charge, is polished or is coated in such a way that, as far as possible, the liquid preparation intended to be applied does not wet the inner surface, in order to facilitate removal of the liquid preparation for cleaning purposes.

A further preferred embodiment of the apparatus is characterised in that the container and the valve arrangement are located at different levels on a carrier stand in such a way that the product-filling and -discharging orifice of the container is located at a lower level than the valve arrangement, when the product-filling and -discharging orifice of the tiltable container points upward.

A further preferred embodiment of the preceding preferred apparatus is characterised in that the valve arrangement comprises a shut-off valve and a charging valve between the shut-off valve and the filling arrangement for the pressure medium.

Further application examples, which may be mentioned, for the apparatus according to the invention are: The paint container, or the paint-mixing container, can be equipped with a distributor device so that the paint or the lacquer can be applied simultaneously through several application devices by means of, for example, brushes, rollers and/or sprayguns.

Of course, the apparatus can also be used for applying two-component or multi-component adhesives or for those chemical products which are sensitive to atmospheric influences and/or must be exposed to the latter only for brief periods.

By means of the invention, the application of the preparations can take place more ecoomically and more uniformly and without processing losses, at a predetermined layer thickness of the coating. Moreover, for reasons of occupational health and environmental pollution, it is intended to restrict the evolution of noxious vapors when using preparations which contain organic solvents. Furthermore, the new apparatus should also be suitable for coating large areas both outside and inside, for example, in shipping, on tanks, and in the rust-prevention sector. According to the invention, the apparatus should, however, also be suitable for conveying liquids of any type, for example, the conveying of beer from the storage cellar into the taproom, liquid media on building sites, and of fuel oil from a storage room at a lower position to the oil furnace located at a higher level.

The subject of the invention is described in the following text—by reference to the figures in the attached drawings—in various illustrative embodiments. However, the scope of the invention is not in any way intended to be restricted to these examples by these illustrative embodiments.

Figure 1:
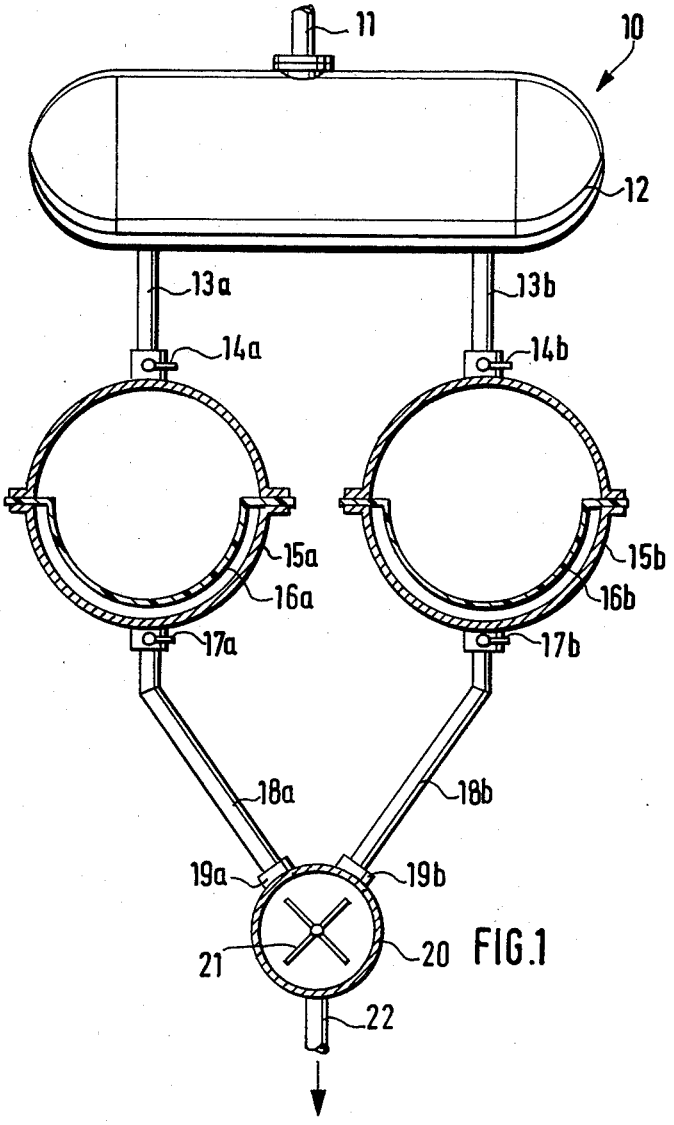
FIG. 1 is an end view in partial section of one form of the invention.

FIG. 1 shows an apparatus according to the invention for applying two-component lacquers. This apparatus is generally marked by the reference number 10. The equipment 10 is provided with a connection 11 for a pressure medium—for example air or water. The pressure medium is passed from a pressure vessel 12 via the connecting lines 13*a* and 13*b* to the spheroidal paint containers 15*a* and 15*b* which are equipped with the diaphragms 16*a* and 16*b*. The inflow of the pressure medium can be controlled with the aid of the valves 14*a* and 14*b*. The paint containers 15*a* and 15*b* contain the various lacquer components which are delivered by the diaphragm pressure from the paint containers through the connecting lines 18*a* and 18*b* to a mixing vessel 20, it being possible to control the amount of inflow of the various components via the valves 17*a* and 17*b* in accordance with instructions. Furthermore, controllable metering nozzles 19*a* and 19*b* are located at the lower end of the connecting lines so that the injection of the various components can be controlled. Appropriately, the mixing vessel is provided with a mixer device so that a complete homogenisation of the various lacquer components becomes possible. The homogenised lacquer is then delivered via a connecting line from the mixing vessel 20 to the devices for applying the lacquer; this device is, however, not included in the figure. The application device can consist of any desired and known devices, such as, for example, brushes, rollers, sprayguns or a casting device. If a roller is used, which is provided, around a hollow shaft, with feed orifices for the liquid preparation which is to be applied, the formation of paint mists can be suppressed.

Figure 2:
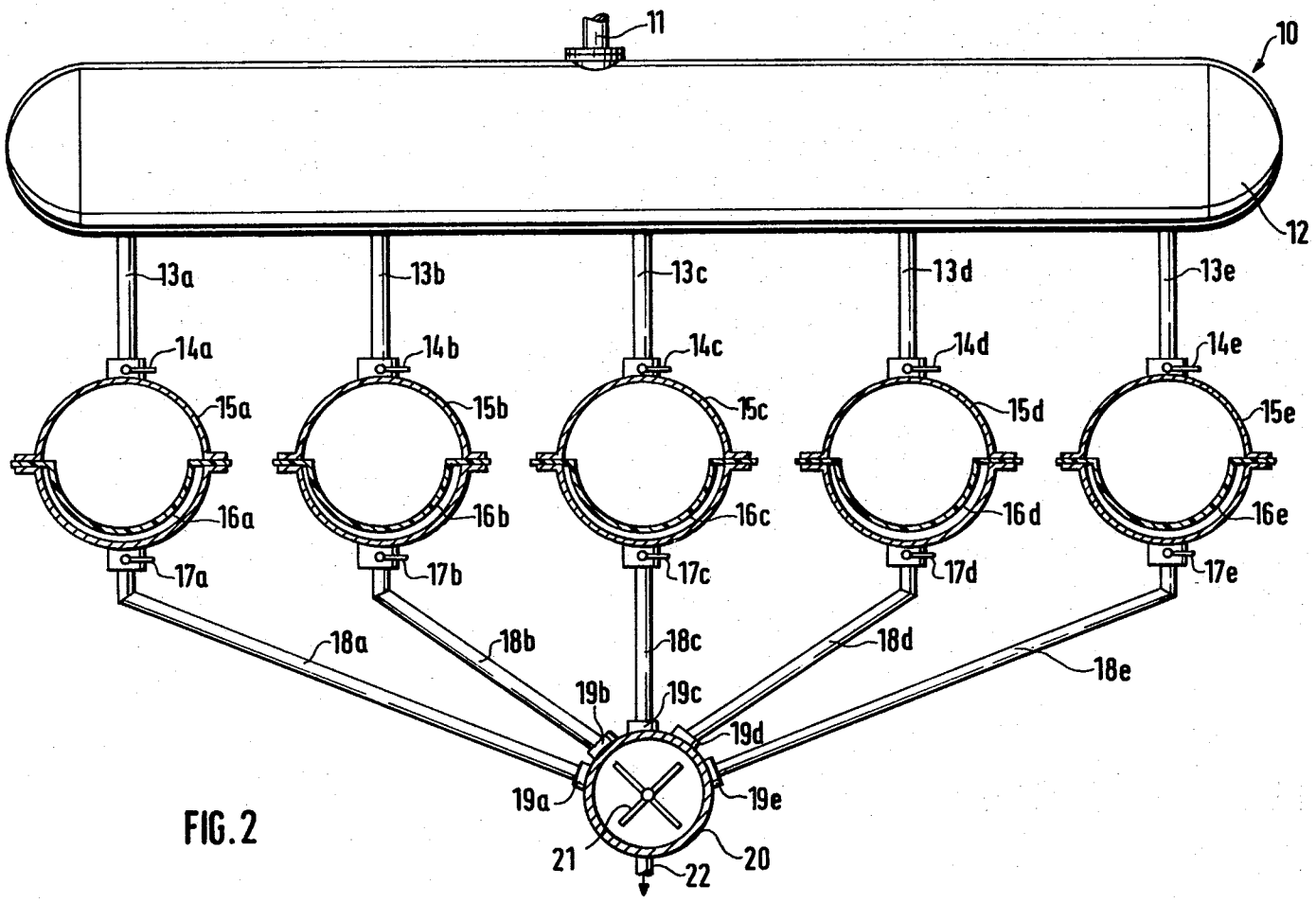
FIG. 2 is an end view in partial section of another form of the invention.

FIG. 2 shows an apparatus according to the invention, in which blending of colour shades and subsequent application of the mixed paint can be carried out in one working step. The example starts with blending four different colours and a diluent, but the number can be varied as desired. The pressure medium is passed from the pressure vessel 12 via the connecting lines 13*a–e* and valves 14*a–e* to the paint containers 15*a–e*. The paint containers in which paints in different colour shades or diluents are present, are provided with the diaphragms 16*a–e*. The paints are delivered from the paint containers via the connecting lines 18*a–e* to the mixing vessel 20, which contains a mixer device 21, and homogenised. For metering in the correct mixing ratio of the various colour shades, the connecting lines are provided with controllable valves 17*a–e* and nozzles 19*a–e*. Finally, the homogenized paint is delivered from the mixing vessel via the connecting line 22 to the devices for the final application of the paint.

With the apparatus according to the invention for applying paints, the latter are preserved completely fresh and come into contact with air only when they are applied to the surface which is to be treated. If necessary or desired, the paint can also be kept in continuous motion in the paint container by means of aids which are in themselves known—for example stirring. It is also possible to keep the temperature of the paint always constant; this can be effected, for example, by installing a heating element and a relay controller.

As already mentioned and also described by constructional examples the present invention can be used in an outstanding manner for processing two-component and multi-component lacquers by feeding the components via controlled valves in the required quantitative ratios to a mixing vessel and homogenising them in the latter. The pot life can readily be adapted to the requirements, and it can also be controlled by adding diluents.

By equipping the device with several paint containers in which paints in different colour shades are present, a virtually unlimited number of colour shades can be produced by feeding definite amounts of paints in different colour shades to a mixing vessel by means of controlled metering valves and with the aid of the pressure diaphragm system and homogenising them in the mixing vessel to give the desired colour shade. In this case, the addition of metered amounts of diluents is also possible.

Figure 3:
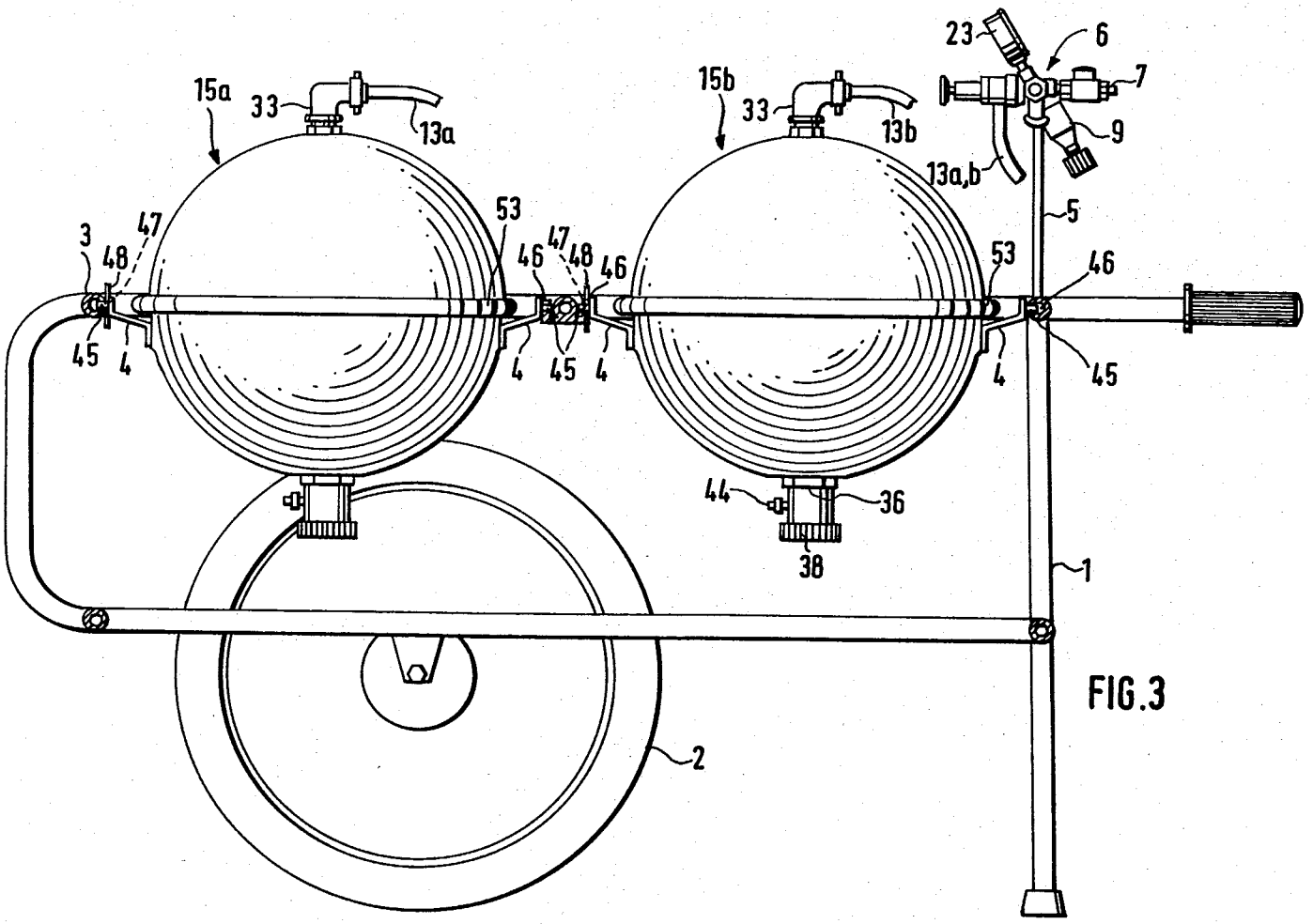
FIG. 3 is a side elevation of still another form of the invention.

FIG. 3 shows a side view of an apparatus according to the invention, some parts not being shown for the sake of clarity and the depicted apparatus having two containers 15*a* and 15*b*.

Figure 4:
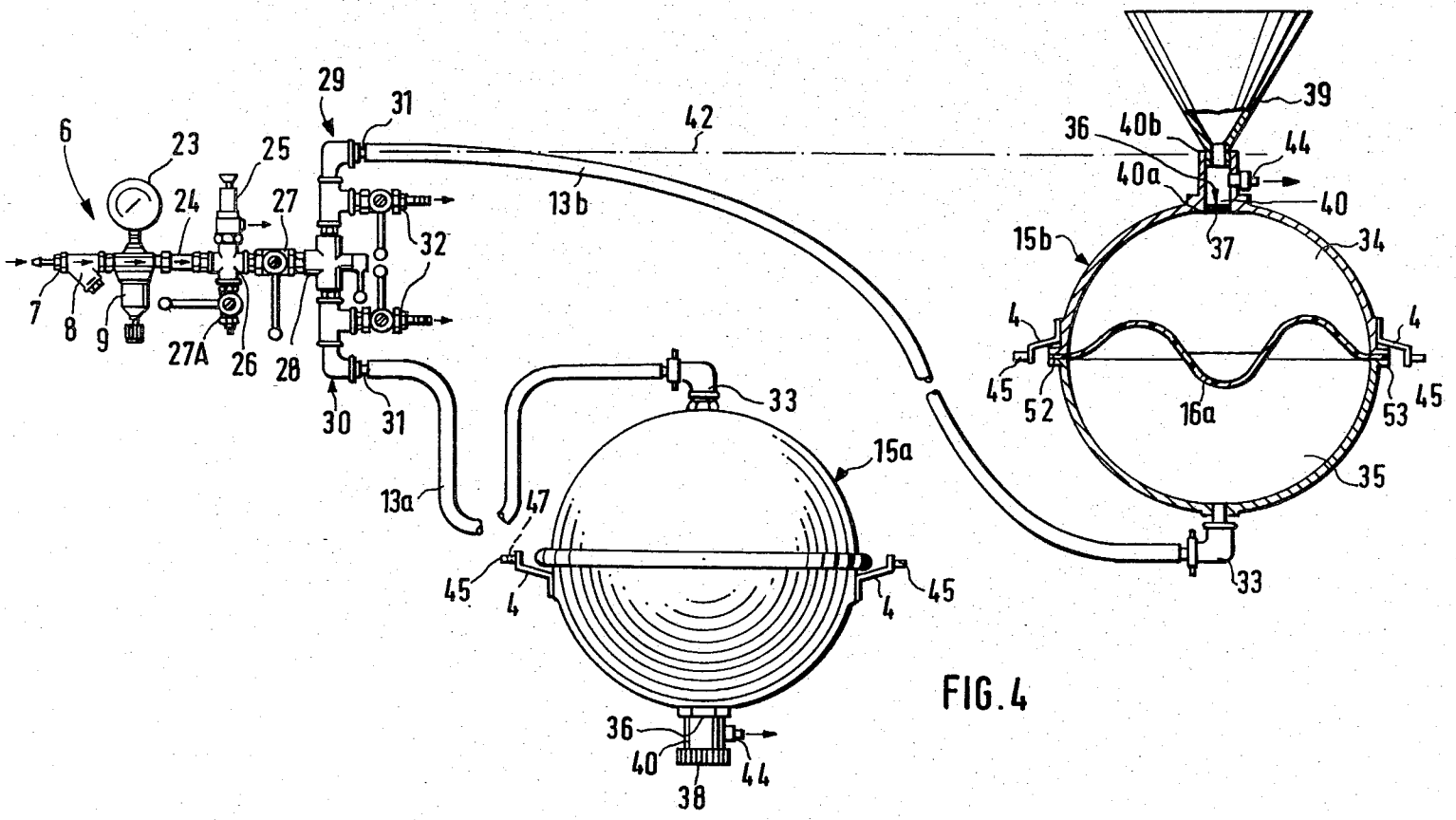
FIG. 4 is a detailed view of the form of the invention shown in FIG. 3.

FIG. 4 diagrammatically shows the important parts of the device, the valve arrangement 6 being shown on the left-hand side of FIG. 4, viewed from above by reference to FIG. 3, and the two containers 15*a*, 15*b* being shown as viewed from the side and partially in section, the right-hand container 15*b* being in the filling position and the left-hand container 15*a* being in the application position. The apparatus possesses a stand 1 which has two wheels 2. Two liquid containers 15*a*, 15*b* are reversibly suspended between the crossbeams 3 with the aid of the suspending and locking device 4. A valve arrangement 6 is fitted on the part 5 of the stand 1, pointing upwards. The device 4 possesses a horizontal axis 45 of rotation which is rotatably held in a recess 46. The axis 45 of rotation has a through-bore 47 for a holding and locking pin 48 which can be pulled out and inserted.

As can best be seen from FIGS. 3 and 4, the valve arrangement 6 comprises a connecting nipple 7 which is provided for connection to a water pipe as a pressure medium. Downstream, the valve arrangement 6 has a dirt filter 8, a reducing valve 9, a manometer 23, a non-return valve 24 and a relief valve 25. The relief valve 25 is fixed to a distributor cross-piece 26 and, opposite the non-return valve 24, there is a valve 27 A which is used when cleaning the apparatus. Furthermore, the valve arrangement possesses a shut-off valve 27, by means of which the supply of pressure medium through the valve arrangement 6 can be completely shut off. Downstream of the shut-off valve 27, there is a switch-over valve 28, by means of which the liquid stream of the pressure medium can be directed to a branch 29 or to another branch 30 or to both branches 29,30. Each of the branches 29,30 has a connecting nipple 31 and a drain valve 32 which is connected between the switch-over valve 28 and the nipple 31. The pressurized water lines 13*a* and 13*b*, which are shown diagrammatically, extend from the nipples 31 up to an inlet 33 for each container 15*a* and 15*b* respectively.

As can best be seen from FIG. 4, the inner closed space of the liquid container 15*b* or 15*a* is sub-divided into two mutually separate part spaces 34 and 35 which are separated by a soft and flexible partition as the diaphragm 16*a*. The soft partition 16*a* is of such a size and flexibility that the mutual size ratio between the two part spaces 34 and 35 is variable between the two extremes in such a way that one part space (for example 34) almost fills the entire container space, whilst the other part space (for example 35) is almost zero so that the converse ratio can also occur. One part space 34 is provided for the product liquid which can consist of painter's colour or adhesive or a component for a painter's colour or an adhesive or of another liquid to be delivered, for example beer or fuel oil. The part space 34 has a product-filling and -discharging orifice 36 which is covered by a screen 37. The product-filling and -discharging orifice possesses a short pipe extension 40 with a containing nipple 44 to which a product-discharging line which is not shown can be connected. This line can be connected to any paint-applying device, an adhesive applicator, a discharge nozzle or another device. The outer part of the pipe extension 40 can be shut off by means of a closure 38 when the apparatus is filled with product liquid. When filling with product liquid, a filling funnel 39 can be placed or inserted through the extension 40, and this is shown on the right in FIG. 4. The screen 37 also has a further important purpose, in that the screen 37 is intended to prevent the diaphragm 16*a* from being pressed by the pressure medium into the discharging orifice 36 when the product liquid has been almost completely expelled.

According to the invention, the liquid container 15*a* or 15*b* and the valve arangement 6 are located in the carrier stand 1 (FIG. 5) at such a relative height that the level line 42 connects the upper edge 40*b* of the pipe extension 40 to the upper connecting nipple 31 so that the lower edge 40*a* of the pipe extension 40 is below the level line 42, when the product-discharging orifice 36 of the reversible liquid container 15*b* points upwards. This arrangement is indicated at the top of FIG. 4 with the aid of the dotted line 42 between the upper connecting nipples 31 and the filling funnel 39. The result of this arrangement is that access of air to the part space 34 through orifice 36 is prevented.

When using the apparatus according to the invention, the filled liquid container 15*a* or 15*b* is locked in position in the stand 1, the product-discharging orifice 36 pointing downwards. After unblocking the water pressure as the pressure medium and setting the switch-over valve 28 into the desired position, the product liquid can be passed through the discharging nipple 44 to an applicator device for paint or adhesives or to a consuming point. When the product liquid is consumed, the liquid container is brought, by rotating it through 180°, into the position which is shown on the right-hand side of FIG. 4, after the liquid feed was shut off by the shut-off valve 27 or the switch-over valve 28 has been set so that the water feed to the liquid container concerned was interrupted. The discharging valve 32 is then opened and filling with new product liquid starts. While the product liquid is filled in, the water in the part space 35 is gradually displaced. This water flows through the nipple 33, the hose 13*b*, the nipple 31 and the discharging valve 32 to a collection vessel which is not shown or directly to a drain. Since the valve arrangement 6 and in particular the parts 31 and 32 of this arrangement are located at a higher level than the outflow orifice 36 of the product space 34, but not higher than the top of the filling tube 40 (as shown in FIG. 4), a back-pressure against the filling with product liquid will always be obtained so that air bubbles in the product space 34 can be avoided in this way. Thus, the pressure in the two compartments is balanced, so that the diaphragm 16*a* is displaced into compartment 35 only so fast as liquid preparation is fed into compartment 34. After the product space 34 has been completely filled with the liquid provided, the funnel 39 is taken off and the closure 38 is screwed on again, whereupon the container is reversed again into its application position by rotating through 180°. The arrangement in which the outlet of the product space 34 is at a somewhat lower level than the discharging valve 32 during the discharge of new product liquid, ensures that the displaced amount of water is equal to the amount of product liquid filled in. This also means that the surface of the product liquid is always at the level of the outlet of the discharging orifice so that it is ensured, independently of the amount of liquid which has been filled into the product space 34, that no air bubbles are included in the liquid system. This construction thus makes it possible to fill in a desired amount of liquid, that is to say it is not necessary always to fill the product space 34 completely with liquid.

As already mentioned earlier, the product-discharging nipples 41 can be connected to an application device which, if painter's colour is used, can be a painter's roller of a particular type. In this type, the bracket consists of a tube which, in the part which is hidden in the shell of the painter's roller, is provided with holes through which the paint is pressed out so that it can then flow out through these orifices in the painter's roller brush. In the handle of the painter's roller, there can be a valve in order to control the feed of liquid to the application device. The apparatus shown can also be used for two-component lacquers, or it is also possible to work with two different colour shades. The apparatus results in an important saving of time, partly because the roller does not have to be dipped into the paint and partly because the required protective cover can be omitted.

An improvement in quality is made possible since the amount of paint in the roller can readily be kept almost constant, partly because the working pressure is set with the aid of the reducing valve and partly by means of the control valve in the handle of the roller.

Another advantage is that the paint does not come into contact with air before the paint reaches the roller. This reduces the need for cleaning work since the bracket and the roller brush have to be cleaned only at the end of a day's work. Trials have shown that paint which was stored for two months in the container, could be further used directly if a new roller was mounted and the apparatus was connected up. The result of this is that the paint consumption can be radically reduced.

When products which contain solvents or noxious products are used, the apparatus has obvious advantages since the liquid products are in a closed system until they are applied.

When the apparatus is used for work with two-component products, the components are filled, each by itself, into their corresponding container. Since the working pressure in the two containers is equal at all times, the feed flow is affected only by the viscosity of the component as long as the dimensions of the liquid hoses are equal. A possible difference in viscosity can here be compensated in a simple manner by varying the through flow quantities by means of a throttle valve in the liquid lines. In the same manner, different mixing ratios can also be set. The two components are passed in separate hoses to the point of application where the two components advantageously are homogenised by means of a static mixer. The mixer is coupled in immediately before the application device.

Work trials have shown that very narrow long hoses can be used: The apparatus is thus particularly advantageous for painting work in confined spaces and for places with difficult access, such as, for example, when painting tank farms or ship's hulls.

Figure 5:
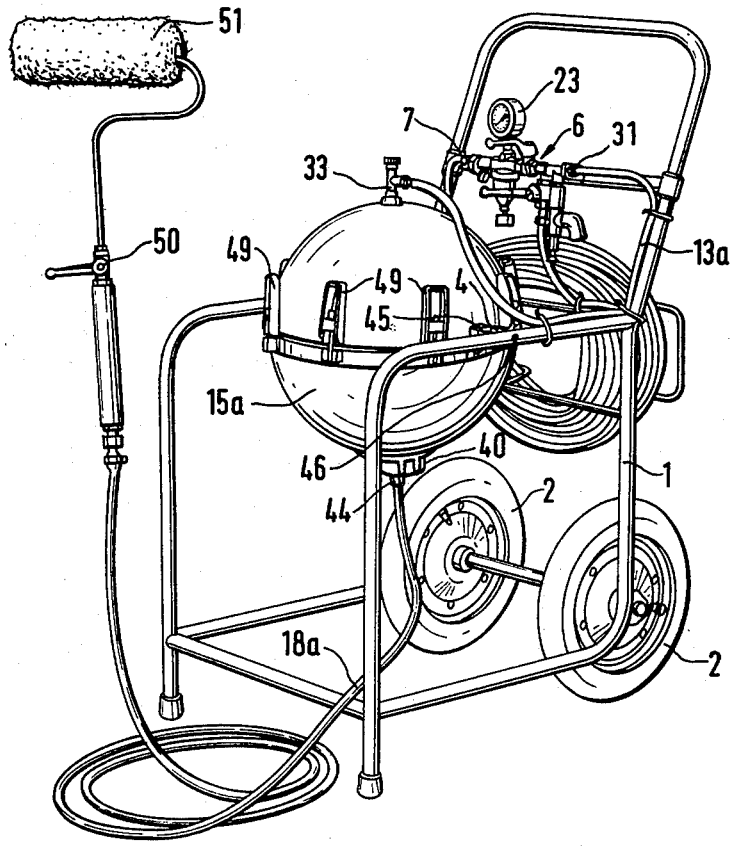
FIG. 5 is an isometric view of the form of the invention shown in FIG. 3.

FIG. 5 is a perspective view of an apparatus according to the invention, which is in a state ready for use and is mounted in a stand 1 which can be moved on two wheels; this relates to the simplest embodiment having a spherical container 15*a*. The spherical container 15*a* is arranged so that it can be rotated about the horizontally disposed axis 45 of rotation and can be locked in position, by means of the holder for the suspension device 4, the tilting axis 45 and the holding and locking pins 48 which can be pulled out and inserted and the recesses 46 as bushes. The upper container part and the lower container part are held together in compression by bayonet closures 49 together with the rim, placed in between, of the soft flexible diaphragm 16*a* which preferably consists of a soft flexible synthetic rubber which is obtained by polymerisation of chloroprene. The lowest part of the lower container part is connected by the line 18*a*, consisting of plastic hose, via the control and shut-off valve 50 to the application device 51 designed as a roller. The frame 1 possesses two wheels 2. The upper container part which, at its uppermost point, has the orifice which is connected via a hose adaptor 33 to the hose 13*a* which supplies the pressure medium, the hose being connected to the valve arrangement 6 which is located at a somewhat higher level and carries the manometer 23, can be seen clearly. A connecting nipple 7 is located to the left of the manometer 23, for making the connection to the water mains via a further hose. The hose lines of the pressure medium—preferably tap water—can consist of plastic or metal. A transparent plastic hose is preferred. The connecting line from the lower container part to the application device consists of an inert hose material based on plastic or metal; for this purpose, however, a transparent plastic hose is preferred. The container 15*a* with the upper container part and the lower container part consists of a suitable inert material, such as plastic, metal or enamelled metal; however, stainless steel is preferred.

I claim:

1. Apparatus for dispensing a liquid preparation comprising a spherical container having demountable upper and lower hemispherical container parts, separated by a soft, flexible diaphragm to provide an expandable and contractable pressurized-fluid chamber and an expandable and contractable preparation chamber, said upper container part having at its acme a pressurized-fluid inlet means which is connected by a first flexible line to a valve means operative to connect said flexible line either to a source of pressurized-fluid or vent means, whereby pressurized fluid can be charged into said pressurized-fluid chamber or vented therefrom as need be, said lower container part having at its nadir an orifice comprising separate filling means and discharge means through which a fluid may be charged into or discharged from said preparation chamber, said discharge means being connected by a second flexible connecting line connecting said discharge means with a point at which said fluid is discharged; means for mounting said container for rotation about a horizontal axis for allowing rotation of said container from a position in which said orifice in said lower container part is uppermost for filling preparation into said preparation chamber to a position in which said orifice is in position for discharge of fluid therefrom, said flexible connecting lines being long enough to permit the rotation of said container for the stated purpose; and back-pressure-establishing means for establishing a back-pressure in said first flexible line when it is connected to said vent means such that said diaphragm does not collapse during filling faster than the preparation is fed into said preparation chamber, in which said back-pressure-establishing means comprises a hydrostatic column in said first flexible line and said vent means being located at a level relative to said filling orifice when said container is in the filling position, such that said diaphragm is displaced into said pressurized-fluid chamber only so fast as liquid preparation is introduced into said preparation chamber and liquid in said hydrostatic column is vented through said vent means.

2. Apparatus for dispensing a liquid preparation comprising a spherical container having demountable upper and lower hemispherical container parts, separated by a soft, flexible diaphragm adapted to provide an expandable and contractable pressurized-fluid chamber and an expandable and contractable preparation chamber, said upper container part having at its acme a pressurized-fluid inlet means which is connected by a first flexible line to a valve means operative to connect said flexible line either to a source of pressurized-fluid or vent means, whereby pressurized fluid can be charged into said pressurized-fluid chamber or vented therefrom as need be, said lower container part having at its nadir an orifice comprising separate filling means and discharge means through which a fluid may be charged into or discharged from said preparation chamber, said discharge means being connected by a second flexible connecting line connecting said discharge means with a point at which said fluid is discharged; means for mounting said container for rotation about a horizontal axis for allowing rotation of said container from a position in which said orifice in said lower container part is uppermost for filling preparation into said preparation chamber to a position in which said orifice is in position for the discharge of fluid therefrom, said flexible connecting lines being long enough to permit the rotation of said container for the stated purpose; and back-pressure-establishing means for establishing a back-pressure in said first flexible line when it is connected to said vent means such that said disphragm does not collapse during filling faster than the preparation is fed into said preparation chamber, and wherein said orifice in said lower container part is of a larger diameter than said pressure-fluid inlet means in said upper container part, said filling means comprises a radially-disposed tubular member having a removable closure, and said discharge means comprises a discharge outlet in the wall of said tubular member, and wherein said back-pressure-establishing means comprises a hydrostatic column in said first flexible line and said vent means is located at a level relative to said filling orifice, when said container is in the filling position, such that said diaphragm is displaced into said pressurized-fluid chamber only so fast as liquid preparation is introduced into said preparation chamber and liquid in said hydrostatic column is vented through said vent means.

3. Apparatus for dispensing a liquid which comprises means for gravity feeding liquid to be dispensed into one compartment of a container divided into two compartments by a flexible diaphragm means for maintaining in the other compartment a liquid under sufficient hydrostatic head to have initially displaced said diaphragm all the way into said one compartment and to maintain a balance in the pressure in the two compartments such that said diaphragm is displaced into said other compartment only so fast as liquid to be dispensed is gravity fed into said one compartment until said one compartment is adequately filled with liquid to be dispensed; and means for thereafter increasing the pressure in said other compartment sufficiently to force liquid to be dispensed from said one compartment.

4. A process for dispensing a liquid preparation comprising gravity feeding liquid to be dispensed into one compartment of a container divided into two compartments by a flexible diaphragm in which the other compartment is filled with a liquid under sufficient hydrostatic head to have displaced said diaphragm into said one compartment and to maintain a balance in the pressure in the two compartments such that said diaphragm is displaced into said other compartment only so fast as liquid to be dispensed is gravity fed into said one compartment until said one compartment is adequately filled with liquid to be dispensed; and thereafter increasing the pressure in said other compartment sufficiently to force liquid to be dispensed from said one compartment.

* * * * *

UNITED STATES PATENT AND TRADEMARK OFFICE

CERTIFICATE OF CORRECTION

PATENT NO. : 4,358,026

DATED : November 9, 1982

INVENTOR(S) : Esa K. Mäkinen

It is certified that error appears in the above-identified patent and that said Letters Patent is hereby corrected as shown below:

Col. 1, line 51; "within" should read -- with --
Col. 3, line 32; "which are" should read -- which is --
Col. 4, line 44; "ecoomically" should read -- economically --

Col. 9, line 53; "diaphragm to provide" should read -- diaphragm adapted to provide --

Signed and Sealed this

*Twenty-second* Day of *March 1983*

[SEAL]

*Attest:*

GERALD J. MOSSINGHOFF

*Attesting Officer*

*Commissioner of Patents and Trademarks*